United States Patent [19]

Foshee

[11] Patent Number: 4,918,950

[45] Date of Patent: Apr. 24, 1990

[54] HIGH SECURITY PADLOCK

[75] Inventor: William R. Foshee, Noblesville, Ind.

[73] Assignee: Best Lock Corporation, Indianapolis, Ind.

[21] Appl. No.: 312,685

[22] Filed: Feb. 21, 1989

Related U.S. Application Data

[60] Division of Ser. No. 55,185, May 28, 1987, Pat. No. 4,836,001, which is a continuation of Ser. No. 718,538, Apr. 1, 1985, abandoned.

[51] Int. Cl.[5] ..... E05B 67/22

[52] U.S. Cl. ..... 70/38A; 70/417

[58] Field of Search ..... 70/38 A, 417, 46, 368, 70/81, 371, 38, 224

[56] References Cited

U.S. PATENT DOCUMENTS

| | | | |
|---|---|---|---|
| 2,282,983 | 5/1942 | Lach | 70/38 A |
| 2,482,177 | 9/1949 | Harbison | 70/38 A |
| 2,489,484 | 11/1949 | Dyson | 70/38 A |
| 3,823,584 | 7/1974 | Gill | 70/38 A X |
| 3,835,675 | 9/1974 | Lippisch | 70/38 A |
| 4,112,715 | 9/1978 | Uyeda | 70/38 A |
| 4,290,279 | 9/1981 | Fish et al. | 70/38 A |
| 4,548,058 | 10/1985 | Bahry et al. | 70/417 X |
| 4,776,187 | 10/1988 | Evans et al. | 70/38 A |

FOREIGN PATENT DOCUMENTS

| | | | |
|---|---|---|---|
| 2380395 | 9/1978 | France | 70/417 |
| 2054021 | 2/1981 | United Kingdom | 70/38 A |

*Primary Examiner*—Vinh T. Luong
*Attorney, Agent, or Firm*—Barnes & Thornburg

[57] ABSTRACT

A lock includes a padlock housing and an interchangeable core including a core body, a core sleeve, and a key plug having a key slot. A bridge member is provided on a flange of the key-way disc to cover a portion of the longitudinal opening of the key slot in the key-way disc. A cylinder cap is mounted on the lock core by a flange and slot connection for removal therewith by a control key which releases control lugs on the lock core from the lock housing cap is used with a lock cylinder, a cylinder ring having a groove in an interior wall that opens toward either the cylinder cap or the lock cylinder is also provided. The exterior surface and the circumferential groove of the cylinder ring are case hardened.

7 Claims, 3 Drawing Sheets

HIGH SECURITY PADLOCK

This is a division of application Ser. No. 07/055,185, filed May 29, 1987 now U.S. Pat. No. 4,836,001 issued on Jun. 6, 1989 which is a continuation of application Ser. No. 06/718,538, filed Apr. 1, 1985, now abandoned.

BACKGROUND AND SUMMARY OF THE INVENTION

This invention relates to lock construction and particularly to a high security lock for use in a padlock of the type referenced in the above parent application. More particularly, this invention relates to the construction of a lock assembly to reduce its vulnerability to destructive physical attack.

A conventional padlock assembly includes a padlock case formed to include a pair of bores for receiving a shackle and a single cavity of FIG. 8 cross-section for receiving an interchangeable lock core.

A conventional lock cylinder assembly further includes a cylinder ring positioned on the lock cylinder housing to surround an exposed portion thereof to protect the lock cylinder housing and interchangeable core from attack. It is known to form a cylinder cap to include a hole alignable with the key plug in the lock cylinder housing to permit a user to insert a key into the key slot of the key plug through the aligned hole when a protective cylinder cap is used in a lockset. An assembly for a padlock is known to include a security harness of sturdy construction that is designed to enshroud the exterior of the padlock case to protect the interchangeable padlock core from destructive physical attack.

Notwithstanding the foregoing known lock features, the security of conventional locks can be violated in many different ways. Several lock-breaking techniques are explained in the following paragraphs. The improved lock of the present invention is specifically constructed to include several advantageous features which cooperate to frustrate the efforts of a lock-attacker who attempts break the security of the improved lock and which simplify the construction and assembly of padlocks. An object of the present invention io to provide a lock that will resist being opened by the application of a rotary force with tools: in the key slot, on the exposed part of a cylinder, or on the exposed portions of the lock assembly.

According to the present invention, a lock comprises a lock housing, and an interchangeable core including a core body, a core sleeve, and a key plug having a key slot. A cap is mounted on the lock housing to protect the core, and a key-way disc is mounted in the cap to protect the key plug while still permitting insertion of an operating or control key into the key slot of the key plug.

The key-way disc includes a secondary key slot for alignment with the primary key slot of the key plug. The cap includes a disc-receiving passageway extending between an outer face and the inner face for alignment with the key plug. The cylinder cap includes a radially inwardly projecting lip in the passageway. The key-way disc includes a cylindrical member having an exterior cylindrical wall and a flange for engaging the cap lip to position the key-way disc in the disc-receiving passageway. The key slot of the cylindrical member opens radially outwardly through the exterior cylindrical wall of the disc. The flange includes a rib member extending radially outwardly from the exterior cylindrical wall of the cylinder portion, and a bridge member integrally coupled to the rib member. The bridge member covers a portion of the key slot opening in the cylinder member's exterior wall and is protectively captured intermediate the lip of the cap and an outer face of the lock core.

According to the present invention, the cap is used with a lock cylinder and includes a cavity for receiving a forward portion of the core body and flange means for engaging the core body to position the cylinder cap in closely-confronting relation to an outer face of the lock cylinder housing when the interchangeable lock core is received in the lock cylinder housing. An upper lobe of the core body is formed to include a pair of lug-receiving slots. Each slot has an opening in an exterior surface of the upper lobe. The flange means includes a pair of lugs for engaging the slots in uppe lobe of the core body. In this embodiment, the cylinder cap is conveniently removable from its cylinder-protecting position by means of the "control" key for the lock since the cylinder cap is carried on the core body of the interchangeable core and the core is itself removable from the lock cylinder by means of said "control" key. A cylinder ring having a drill-resistant circumferential groove is installable on the cylinder housing to protectively surround the cylinder cap.

According to the present invention, the cap is used with a padlock and includes a cavity for receiving a forward portion of the core body and flange means for engaging the core body to position an inner face of the padlock cap in communication with a core-receiving chamber formed in the padlock to protectively block at least a portion of the shield to protect a padlock core from being pulled, drilled, chiseled, or damaged using other methods during an attack. An upper lobe of the core body is formed to include a pair of lug-receiving slots. Each slot has an opening in the exterior surface of the upper lobe. The flange means includes a pair of lugs for engaging the slots in the upper lobe of the core body. In this embodiment, the padlock cap is removable from its recessed core-protecting position within the padlock case by means of the control key for the lock since the padlock cap is carried on the core body of the interchangeable core and the core is itself removable from the padlock case by means of said control key.

Another feature of the present invention is the provision of a cylinder cap including flange means for engaging the lock core body to position the cylinder cap in closely-confronting relation to an outer face of the lock cylinder housing when the interchangeable lock core is received in the housing. This feature advantageously permits key removal of the cylinder cap to expedite disassembly of the lock for core replacement or recombination. In addition, this feature advantageously blocks rotation of the cylinder cap in respect to the lock cylinder housing during an attack.

Yet another feature of the present invention is the provision of a padlock cap including flange means for engaging the lock core body to position the cap in a recess in the padlock case to protect the interchangeable lock core body while it is received in its chamber in the padlock case. This feature advantageously permits key removal of the cap in a padlock environment to expedite disassembly of the lock for core replacement or recombination. Further, the placement of the padlock cap in a recess formed in the padlock case protects the core from being pulled with a "slam-puller," a "nose-puller," or other similar lock attack tool.

Still another feature of the present invention is the provision of a free-wheeling key-way disc to improve the pick-resistance and drill-resistance of a lock. The key-way disc provides an additional obstacle a lock-attacker must overcome during an attempt to pick the lock by hanging the segment pins on either the "operating" or "control" shearline. It is more difficult to insert a tension device into the key slot of a key plug when the key-way disc of the present invention is installed in a cylinder cap. Further, the key-way disc provides a barrier to prevent someone from drilling into the key plug.

Another feature of the present invention is the provision of a bridge member on the flang of the key-way disc. The bridge member is substantially inaccessible and hidden from view under a lip formed on the cap to prevent a lock-attacker from breaking the exposed part of the key-way disc with a chisel, collapsing the disc together about its key slot, and prying the disc out of the passage in the cap to gain access to the key plug.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWING

Figure 1:
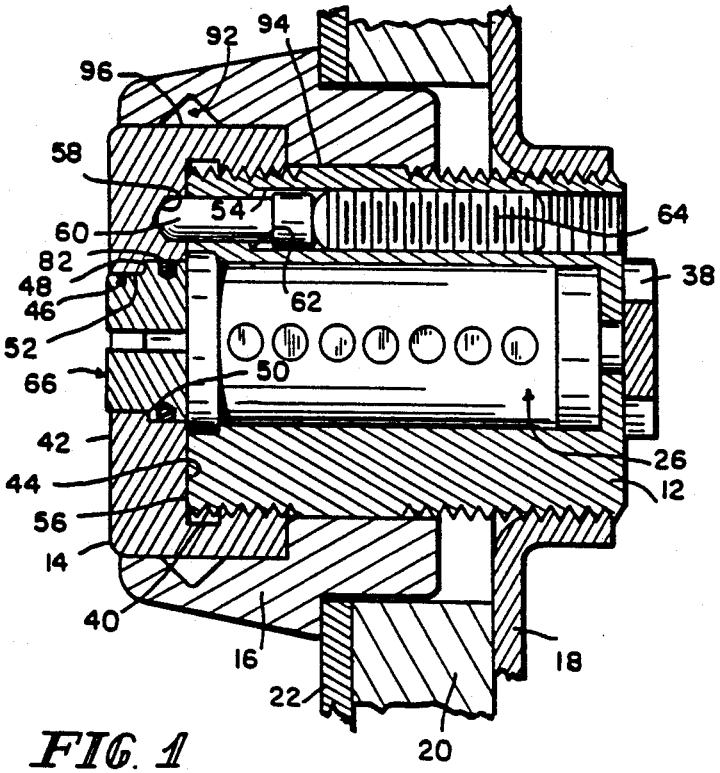
FIG. 1 is a longitudinal section of a lock incorporating one of hte preferred embodiments of the present invention.
Figure 2:
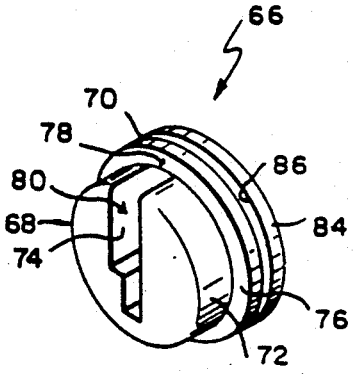
FIG. 2 is an enlarged isometric view of the freely rotatable key-way disc illustrated in FIGS. 1 and 4 showing the bridge member.
Figure 3:
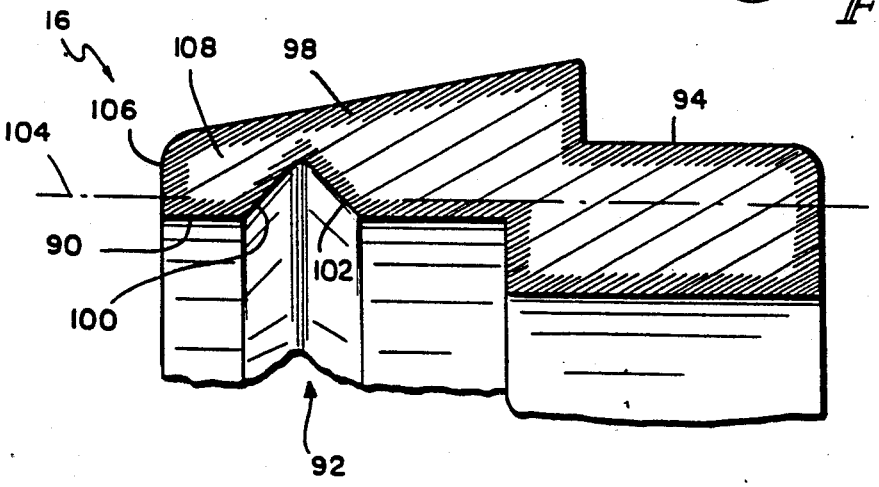
FIG. 3 is an enlarged view of the cylinder ring illustrated in FIGS. 1 and 4.
Figure 4:
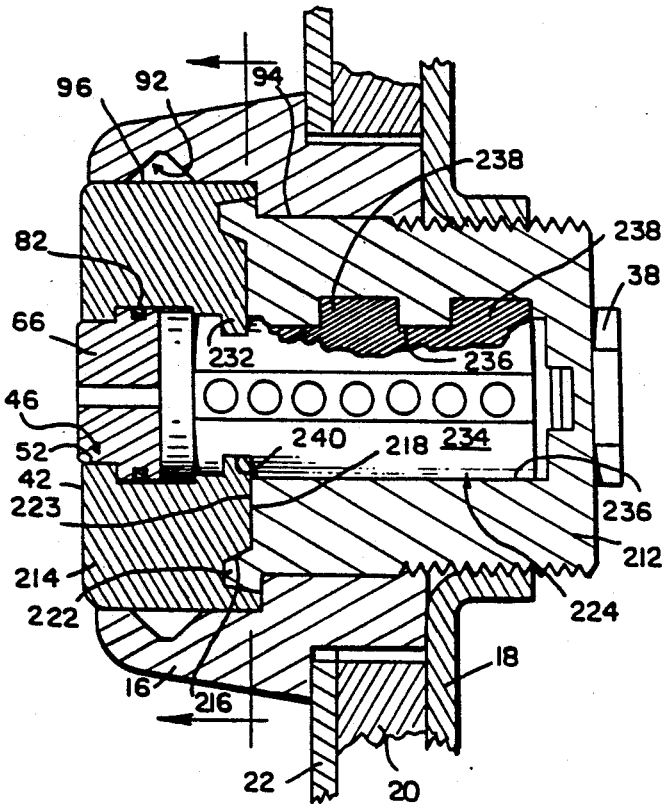
FIG. 4 is a longitudinal section of a lock incorporating another of the preferred embodiments of the present invention with portions broken away showing a key-removable cylinder cap mounted on an interchangeable lock core.

The lock shown in FIGS. 1–6 comprises a lock cylinder housing 12, a cylinder cap 14 and 214, and a cylinder ring 16. The lock is conveniently installable in the customary manner in the case 18 of a mortise lockset mounted in a door 20. It will be understood that the lock of the present invention shown in FIGS. 1–6 can be used in any application calling for a cylinder lock. As shown in FIGS. 1 and 4, the cylinder cap 14 is mounted on a forward portion of lock cylinder housing 12. The cylinder ring 16 is captured between the mounted cylinder cap 14 and an escutcheon 22 positioned on the door 20.

Figure 1A:
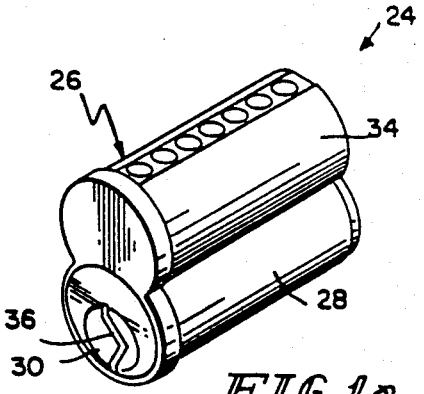
FIG. 1*a* is a perspective view of the interchangeable lock core illustrated in FIG. 1.

An interchangeable lock core 24 is illustrated in FIG. 1*a*. The interchangeable core 24 includes a core body 26. The core body 26 is desirably of FIG.-8 cross section. It is within the scope of the present invention to use a different type of lock core. The core body 26 has a lower lobe 28 which contains a key plug 30 and a core sleeve 32 (See FIG. 6), and an upper lobe 34 which contains pin tumblers or segments (not shown). The key plug 30 is formed with an axial broached key slot 36 and is rotatably mounted within the core sleeve 32 (See FIG. 6). A conventional throw member and throw pin assembly (not shown) is rotatably mounted in the key plug 30 and is fixed to a lock-actuating cam 38 for transmitting key-plug rotation to a secondary lock mechanism, as is known in the art, and as shown in the Best U.S. Pat. No. 1,564,463. The core body 26 is adapted to be mounted in the lock cylinder housing 12 as shown in FIGS. 1.

In the embodiment of FIGS. 1–3, the cylinder cap 14 is threadedly engaged to the forwardmost end 40 of lock cylinder housing 12. The cap 14 includes a forward face 42 and a rearward face 44. The cap 14 includes a key-way disc-receiving passageway 46 extending between the forward face 42 and the rearward face 44. The passageway 46 includes a radially inwardly projecting circumferential lip 48 having a rearwardly presented surface 50, and an interior surface 52. As shown in FIG. 1, the cylinder cap 14 is moutned to the lock cylinder housing 12 to cause the rearward face 44 to lie in confronting relation with the lock cylinder housing 12.

The lock cylinder housing 12 further includes a longitudinal bore 54 having an opening in the outer face 56 of the lock cylinder housing 12. The cylinder cap 14 includes a pin-receiving recess 58 formed in the rearward face 44 of the cylinder cap 14. A blocking pin 60 is received in the longitudinal bore 54 for free rotation therein. The blocking pin 60 is extendable through the bore opening to engage the recess 58 in the cylinder cap 14. Extension of pin 60 is limited by chamfer 62 illustrated in FIG. 1. A setscrew 64 is threadedly received in the longitudinal bore 54 and extendable therein to urge the freely rotatable blocking pin 60 toward its engaged position in the cylinder cap 14 to block rotation thereof. The blocking pin 60 spins freely when drilled to complicate backing off the setscrew 64 to violate the security of the lock.

A key-way disc 66 includes a cylinder member 68 and a second flange 70. The cylinder member 68 includes an exterior surface 72 and is formed to include a key slot 74 for alignment with the key slot 36 of the key plug 30. The key slot 74 opens radially outwardly through the exterior cylindrical wall 72 of the cylinder member 68. The second flange 70 includes rib member 76 and a novel bridge member 78. The rib member 76 extends radially outwardly from the exterior cylindrical wall 72 of the cylinder member 68. The bridge member 78 is integrally coupled to the rib member 76 as best shown in FIG. 2. The function of the novel bridge member 78 is to cover a portion of the longitudinal opening 80 of the key slot 74 in the exterior cylindrical wall 72 of the cylinder member 68.

The key-way disc 66 is retained within the passageway 46 of the cylinder cap 14 by means of a wire spring 82 or the like. In a preferred embodiment, the cylinder member second flange 70 includes a radially outwardly facing surface 84 formed to include a circumferential wire-receiving groove 86. The wire spring 82 is received in groove 86 to fix the key-way disc 66 in the passageway 46 by means of a snug fit among the exterior surface 84, the wire spring 82, and the interior surface 52 of the cylinder cap passageway 46. In its retained position, the second flange 70 abuts the rearwardly presented surface 50 of the cap lip 48 so that the bridge member 78 is protectively captured intermediate the cylinder cap 14 and the lock cylinder housing 12. The bridge member 78 advantageously prevents a lock-attacker from drilling or breaking an exposed portion of the key-way disc 66 to cause the disc to collapse inwardly about its key slot 74 so that the lock-attacker can pry the disc 66 out of the passage 46 in the cylinder cap 14 to gain access to the key plug 30.

The cylinder ring 16 is installed intermediate the cylinder cap and lock cylinder housing assembly and the escutcheon 22 to protect the interchangeable core 24 from attack. The cylinder ring 16 includes a contoured interior wall 90 as shown best in FIG. 3. The interior wall 90 includes a circumferential V-shaped groove 92. The V-shaped groove 92 has an opening in the interior wall 90 such that the groove opens toward the exterior surface 94 of the lock cylinder housing 12 and toward a radially outwardly presented surface 96 of the cylinder cap 14.

The stainless steel cylinder ring 16 is heat-treated using a conventional ion nitride heat-treating process to case harden the outer surface to a certain depth as indicated by reference numeral 98 to resist attack as by drilling. Internally, the heat-treated cylinder ring 16 remains soft and non-brittle to resist breakage. Thus, the cylinder ring 16 is drill resistant and also not brittle. It will be appreciated that surfaces 100, 102 of the V-shaped groove are also case-hardened during the ion nitride process. Thus, a drill in use to attack and split cylinder ring 16 along line 104 will encounter not only hardened exterior surface 106, but also the pair of hardened groove surfaces 100 and 102 as shown in FIG. 3. The cylinder ring 16 can resist drilled attack even if hardened surface 106 is penetrated by a center punch to expose the softer interior 108 since the drill bit will still encounter hardened surfaces 100 and 102. These surfaces 100 and 102 are angled in respect to the direction of drill travel 104 to "cam" the drill bit along the surface and break it. The harder the lock-attacker forces the drill bit to penetrate either of angled hardened surfaces 100 and 102, the more likely it is that the drill bit will be broken.

Figure 5:
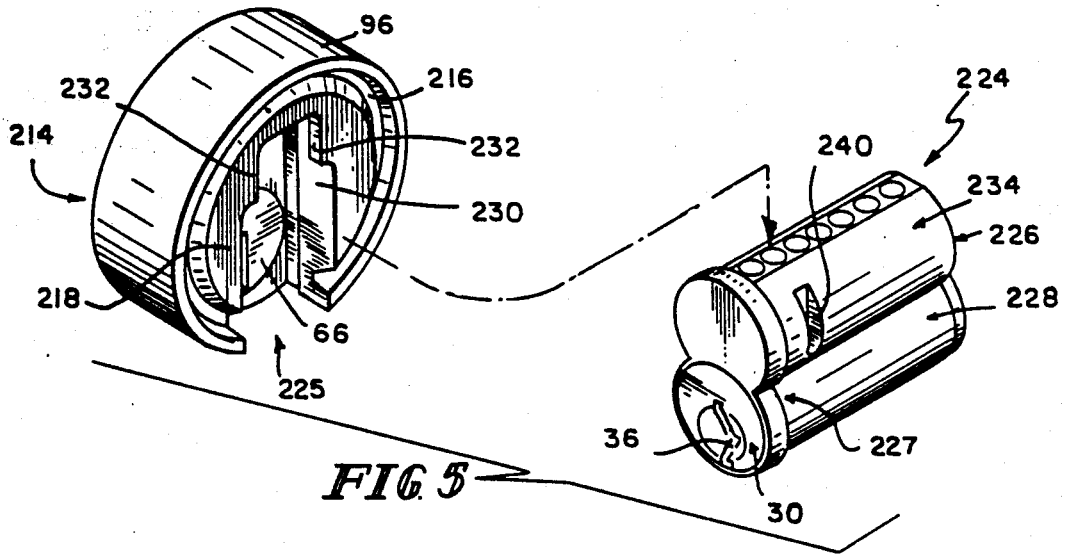
FIG. 5 is an exploded perspective view of a portion of the lock illustrated in FIG. 4 showing the assembly of the cylinder cap onto the interchangeable lopck core.
Figure 6:
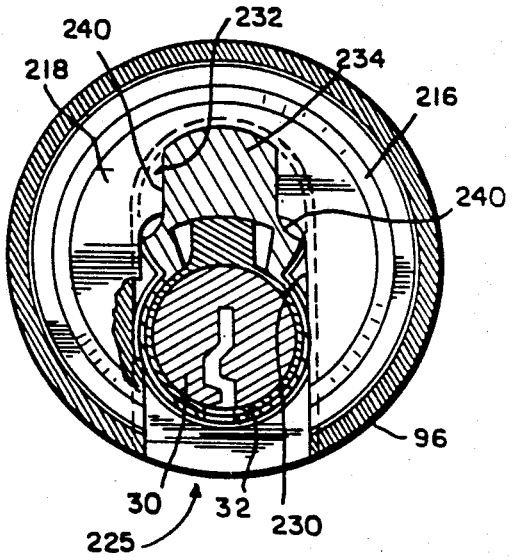
FIG. 6 is a transverse section of the embodiment shown in FIG. 4 taken along lines 6—6 of FIG. 4 with portions broken away.

In the embodiment of the invention illustrated in FIGS. 4–6, those elements numbered identically with the embodiment of FIGS. 1–3 perform the same or similar functions. In the embodiment of FIGS. 4–6, the threaded cylinder cap 14 which is threadedly engageable with the lock cylinder housing 12 is replaced by an unthreaded cylinder cap 214 which is slidably engageable with the modified upper lobe 234 of the key-removable interchangeable lock core 224 of FIG.-8 cross-section. Thus, cylinder cap 214 is removable from its lock-protecting position shown best in FIG. 4 solely by means of the control key (not shown) used to remove the interchangeable lock core 224 from its chamber in the lock cylinder housing 212.

The key-removable cylinder cap is designed to include a flange-receiving recess 216 formed in the rear face 218 thereof. The lock cylinder housing 212 includes a flange 222 along a radially outer portion of its forward face 223. The cylinder cap 214 is formed to include a cavity 225 for receiving a forward portion 227 of the core body 226. The cavity 225 includes a side wall 230 for embracing the exterior surface of the upper lobe 234 of the core body 226. The cylinder cap 214 further includes a pair of flanges 232. Each flange 232 extends radially inward from the side wall 230 so that the flanges 232 confront one another in spaced-apart relation as best shown in FIG. 5. The upper lobe 234 of the core body 226 is formed to include a pair of flange-receiving slots 240 as best illustrated in FIG. 5.

Assembly of the cylinder cap 214 onto the interchangeable lock core 224 is accomplished by first installing the key-way disc 66 into the passaged 46 of the cylinder cap 214. Then the cap 214 is mounted by sliding the cap 214 onto the forward end 227 of the core 224 as shown in FIG. 5 to cause the pair of confronting flanges 232 to engage the slots 240 in the upper lobe 234 of the core body. Once assembled, the cap/lock core assembly can be installed in the core receptacle 236 by using the control key (not shown) to operate the control lugs 238 to move the lugs 238 to a core-retaining position.

Figure 8:
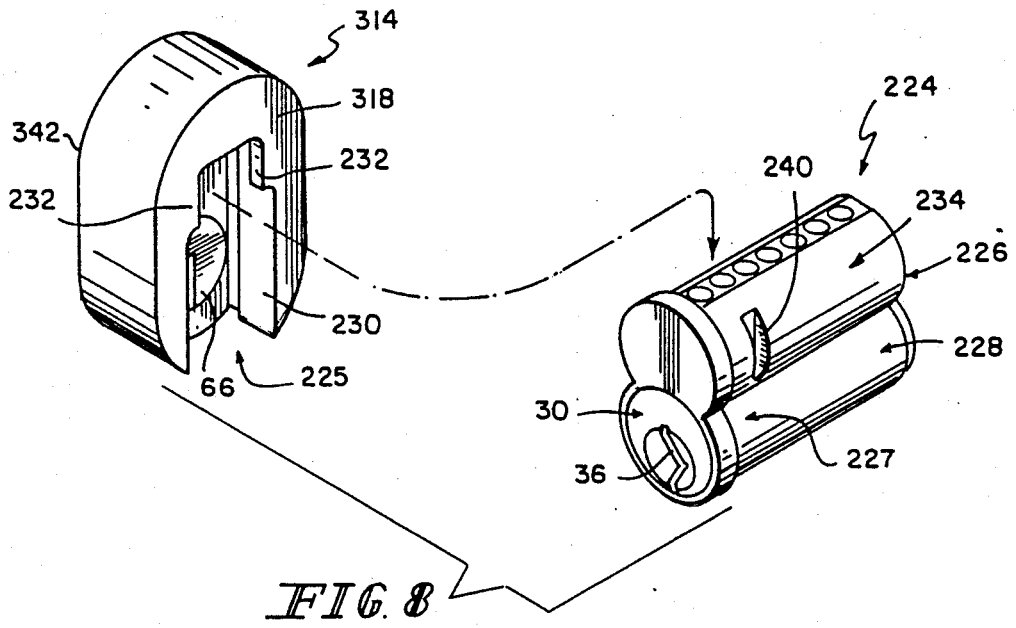
FIG. 8 is an exploded perspective view of a portion of the lock illustrated in FIG. 7 showing the assembly of the padlock cap onto the interchangeable lock core.
Figure 7:
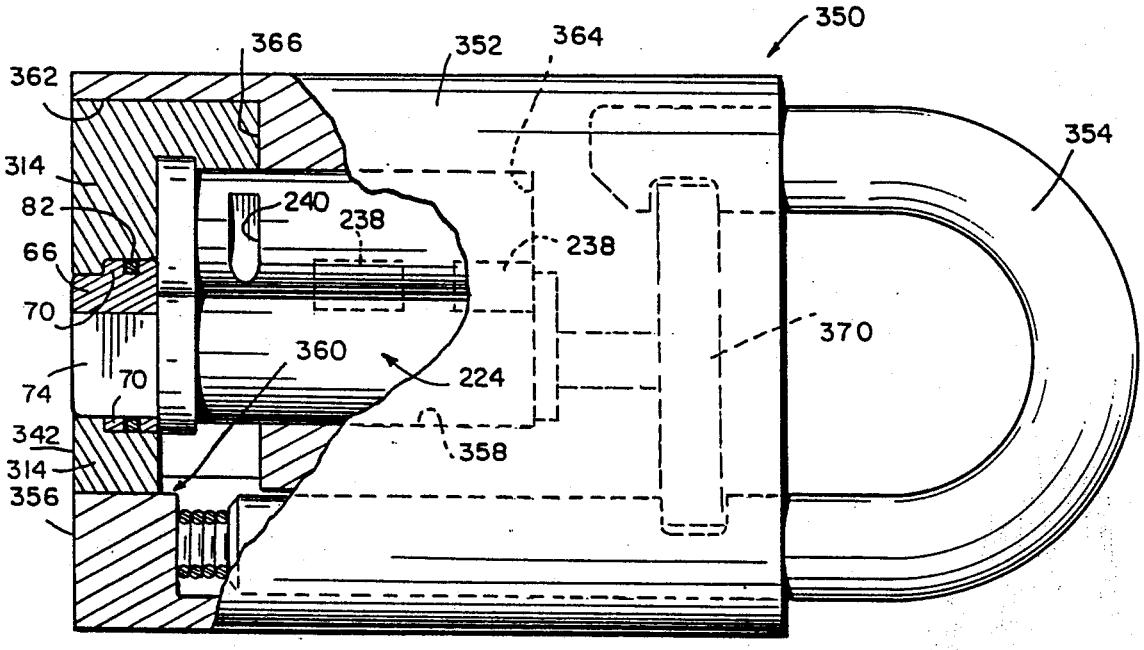
FIG. 7 is a top plan view of a padlock incorporating yet another of the preferred embodiments of the present invention with portions broken away showing a key-removable padlock cap mounted on an interchangeable lock core.
Figure 9:
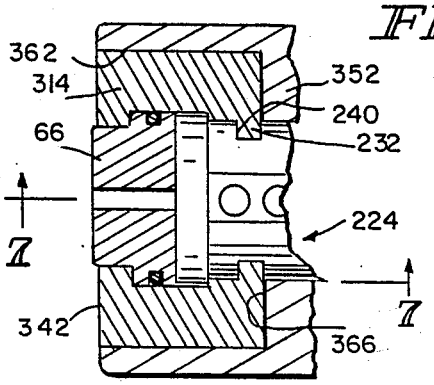
FIG. 9 is a partial transverse sectional view taken through the padlock illustrated in FIG. 7 showing the engagement of flanges on the padlock cap with flange-receiving slots formed in the lock core.

In the embodiment of the invention illustrated in FIGS. 7, 8, and 9 those elements numbered identically with the embodiments of FIGS. 1–6 perform the same or similar functions. In the embodiment of FIGS. 7, 8, and 9 a cap and core assembly is installed in a padlock 350 having a padlock case 352 and a shackle 354. The padlock case 352 includes a bottom end wall 356 and is formed to include a deep chamber 358 of FIG.-8 cross section for the reception of the interchangeable lock core 224 and a shallow chamber 360 of generally oval cross section for the reception of a padlock cap 314 mounted on core 224. Both chambers 358 and 360 are accessible via an opening 362 formed in the bottom end wall 356 of the padlock case 352. An outwardly presented surface 364 is defined by the bottom wall of the deep core-receiving chamber 358. The padlock cap 314 includes a rear face 318 and forward face 342 as well as other features 225, 230, and 232 described in connection with the embodiment of FIGS. 4–6.

Assembly of the padlock cap 314 onto the interchangeable lock core 224 is accomplished by first installing key-way disc 66 in the padlock cap 314. Then the cap 314 is mounted by sliding the cap 314 onto the forward end 227 of the core 224 as shown in FIG. 8 to cause the pair of confronting flanges 232 to engage the slots 240 in the upper lobe of the core body. The engagement of the pair of confronting flanges 232 with slots 240 is best shown in FIG. 9. Once assembled, the cap/lock core assembly can be installed in the padlock case 352 by positioning the rearward end of the core 224 in the deep chamber 358 to seat against the outwardly presented surface 364 and shackle bolt 370 while the padlock cap 314 in the shallow chamber 360 to seat against a ledge 366 in the padlock case 352, and by using the control key (not shown), to move the control lugs 238 to a core-retaining position. In its mounted position in the shallow chamber 360, the forward face 342 of the padlock case is desirably flush with the bottom end wall 356 of the padlock case 352. One advantage of this embodiment of the present invention is that it provides a security shield that is sheltered in the interior of the padlock case and has a key face that is flush with the adjacent face of the padlock to protect padlock cores from being pulled from a padlock case by means of a "nose-puller" or other lock attacking tool that is superior to conventional cage-like security shields or traps which are generally constructed using sheet metal components and embrace the exterior of the padlock case to protect the padlock core. Moreover, the padlock cap 314 of the present invention is conveniently removable by means of the control key in addition to providing an improved security shield.

Although the invention has been described in detail with reference to certain preferred embodiments and specific examples, variations and modifications exist within the scope and spirit of the invention as described and defined in the following claims.

What is claimed is:

1. A lock comprising:

a padlock case having a bottom end wall, the padlock case being formed to include a core-receiving chamber having an opening in the bottom end wall, a lock core in the core-receiving chamber, a padlock cap having a rear face, and means for mounting the padlock cap on the lock core to protectively block at least a portion of the chamber opening in the bottom end wall of the padlock case, wherein the lock core includes:

a core body of figure-eight cross section having an upper lobe and an integral lower lobe, the upper lobe having an exterior surface, the lower lobe being formed to include a chamber for receiving a key plug, and wherein the mounting means depends from the rear face of the padlock cap and includes flange means for detachably engaging the padlock cap to an exterior surface of the upper lobe of the core body.

2. The lock of claim 1, wherein the upper lobe of the core body is formed to include at least one flange receiving slot having an opening in the exterior surface of the upper lobe, the padlock cap is formed to include a cavity configured to receive at least a portion of the core body, the cavity having a side wall embracing the exterior surface of the upper lobe, and the flange means engaging said at least one flange receiving slot in the upper lobe upon insertion of the core body into the cavity of the padlock cap.

3. The padlock of claim 1, wherein the lock core includes a key plug rotatably mounted therein, the key plug is formed to include a first key slot for receiving an operating key, the padlock cap has an outer face and an inner face, the padlock cap is formed to include a disc-receiving passageway extending between the outer and inner faces for alignment with the key plug, the padlock cap includes a radially inwardly projecting lip extending into the passageway, the padlock cap further includes a keyway disc mounted in the disc-receiving passageway for rotation relative to the key plug, the keyway disc includes a cylinder member having an exterior cylindrical wall and is formed to include a second key slot for alignment with the first key slot of the key plug, the second key slot opens radially outwardly through the exterior cylindrical wall, and second flange means for engaging the radially inwardly projecting lip of the padlock cap to position the keyway disc in the disc-receiving passsageway adjacent to the key plug, the flange second means including a rib member extending radially outwardly from the exterior cylindrical wall of the cylinder member and bridge member coupled to the rib member to cover a portion of the key slot opening in the exterior cylindrical wall of the cylinder member.

4. The padlock of claim 3, wherein the lip includes a rearwardly presented surface, the padlock cap is received in the cavity of the padlock housing to cause the rearwardly presented surface of the padlock cap to lie in confronting relation with the lock core, and further comprising means for retaining the keyway disc in the passageway to cause the flange means to abut the rearwardly presented surface so that the bridge member is protectively captured intermediate the padlock cap and the lock core.

5. The padlock of claim 4, wherein the padlock cap includes an interior surface configured to define the passageway, the second flange means includes a radially outwardly facing exterior surface formed to include a recess, the exterior surface of the second flange means is situated in closely confronting relation to the interior surface of the padlock cap and the retaining means includes a resilient member received in the recess to fix the keyway disc in the passageway by means of a fit among the exterior surface of the second flange means, the resilient member, and the interior surface of the padlock cap.

6. A lock comprising:

a padlock case having a bottom end wall, the padlock case being formed to include a core-receiving chamber having an opening in the bottom end wall, a lock core in the core-receiving chamber, a padlock cap having a rear face, and means for mounting the padlock cap on the lock core to protectively block at least a portion of the chamber opening in the bottom end wall of the padlock case, wherein the lock core further comprises:

a key plug rotatably mounted in the core body, the key plug including a front face and being formed to include a first key slot having an opening in the front face for receiving an operating key, the padlock cap further including a forward face, the padlock cap being formed to include a disc-receiving passageway extending between the forward and rearward faces for alignment with the key plug, the passageway having a radially inwardly projecting lip, and a keyway disc including a cylinder member having an exterior cylindrical wall and being formed to include a second key slot for alignment with the first key slot of the key plug, the second key slot opening radially outwardly through the exterior cylindrical wall, and second flange means for engaging the radially inwardly projecting lip of the padlock cap to position the keyway disc in the disc-receiving passageway, the second flange means including a rib member extending radially outwardly from the exterior cylindrical wall of the cylinder member and a bridge member coupled to the rib member to cover a portion of the key slot opening in the exterior cylindrical wall of the cylinder member, the rib member and bridge member cooperating to define a rearwardmost surface of the keyway disc that is positioned in substantially abutting relation to the front face of the key plug.

7. A padlock comprising:

a lock core having an exterior surface, a padlock cap mounted on the lock core, the padlock cap having a radially outwardly presented exterior surface, and a padlock housing formed to include an interior wall defining a cavity for receiving the padlock cap and the lock core, the interior wall surrounding the exterior surfaces of the lock core and padlock cap to protect the core and cap from external attack;

wherein the padlock housing has an outer face, the lock core has a longitudinal axis and includes a core body of figure-eight cross section having an upper lobe and an integral lower lobe, the upper lobe having an exterior surface, the upper lobe of the core body being formed to include at least one flange receiving slot having an opening in the exterior surface of the upper lobe, the lower lobe being formed to include a chamber for receiving a key plug, and the padlock cap has a rear face, the padlock cap is formed to include a cavity for receiving a portion of the core body, the cavity has a side wall for embracing the exterior surface of the upper lobe, the padlock cap further includes:

flange means depending from the rear face of the padlock cap for engaging the flange receiving slot of the lock core to interlock the padlock cap and the lock core against axial separation in opposing directions along the longitudinal axis of the lock core and to position the rear face of the padlock cap in closely confronting relation to the outer face of the lock core to protectively cover at least a portion of said outer.

* * * * *

UNITED STATES PATENT AND TRADEMARK OFFICE

CERTIFICATE OF CORRECTION

PATENT NO. : 4,918,950

DATED : April 24, 1990

INVENTOR(S) : Foshee

It is certified that error appears in the above-identified patent and that said Letters Patent is hereby corrected as shown below: ON TITLE PAGE:

In the section entitled "References Cited" the following patents should be listed:

| | | | |
|---|---|---|---|
| --1,714,423 | 5/29 | Jacobi | |
| 2,059,694 | 11/36 | Jacobi | 70/46 |
| 2,073,583 | 3/37 | Olson | 70/368 |
| 2,744,405 | 5/56 | McClelland | 70/81 |
| 3,402,582 | 9/68 | Jacobi | 70/371 |
| 3,882,699 | 5/75 | Flack et al. | 70/38 |
| 4,222,253 | 9/80 | Peitsmeier | 70/417 |
| 4,435,967 | 3/84 | Best et al. | 70/224 |
| 4,545,223 | 10/85 | Poutiainen et al | 70/38 |
| 1,564,463 | 12/25 | Best | 70/380 |
| 1 553 311 | 9/69 | Germany--. | |

In column 1, line 43, replace "io" with --is--.

In column 2, line 17, replace "uppe" with --upper--.

In column 2, line 33, after "the", insert --chamber opening and thereby provide a padlock security--.

In column 3, line 13, replace "flang" with -- flange --.

In column 3, line 31, replace "hte" with --the--.

In column 3, line 47, replace "lopck" with --lock--.

In column 6, line 20, replace "passaged" with --passage--.

In column 8, line 1, replace "flange second" with --second flange--.

UNITED STATES PATENT AND TRADEMARK OFFICE

CERTIFICATE OF CORRECTION

PATENT NO. : 4,918,950

DATED : April 24, 1990

INVENTOR(S) : Foshee

It is certified that error appears in the above-identified patent and that said Letters Patent is hereby corrected as shown below:

In column 10, line 15, after "outer", insert --face--.

Signed and Sealed this

Eighth Day of October, 1991

*Attest:*

HARRY F. MANBECK, JR.

*Attesting Officer*

*Commissioner of Patents and Trademarks*